United States Patent [19]

Graham

[11] Patent Number: 4,593,684

[45] Date of Patent: Jun. 10, 1986

[54] OCCIPITAL SUPPORT FOR CERVICAL TRACTION

[76] Inventor: Erwin W. Graham, 13565 Wendy La., Saratoga, Calif. 95070

[21] Appl. No.: 585,361

[22] Filed: Mar. 1, 1984

[51] Int. Cl.[4] ..... A61H 1/02

[52] U.S. Cl. ..... 128/75; 128/68; 5/436; 297/396

[58] Field of Search ..... 128/71, 75, 68, 69; 5/434, 435, 436, 437, 440; 272/72; 297/391, 396, 400, 406, 408, 409, 410

[56] References Cited

U.S. PATENT DOCUMENTS

| | | | |
|---|---|---|---|
| 381,187 | 4/1888 | Tracy | 272/72 |
| 833,987 | 10/1906 | Truslow | 5/440 |
| 2,581,802 | 1/1952 | Lyons | 5/440 |
| 2,703,080 | 3/1955 | Sanders | 128/71 X |
| 2,904,039 | 9/1959 | Weissenberg | 128/71 X |
| 3,621,839 | 11/1971 | Barthe | 128/75 |
| 4,124,126 | 11/1978 | Spinks | 128/71 |
| 4,166,459 | 9/1979 | Nightingale | 128/75 |
| 4,515,406 | 5/1985 | Fujiyama et al. | 297/409 |

*Primary Examiner*—Richard J. Apley
*Assistant Examiner*—Alan W. Cannon

[57] ABSTRACT

A cervical traction device with a movable carriage carrying a head support which may be used with either internal or external traction means. Force is applied to the occipital region of the back of the skull of a supine user through a taut, resilient, elastomeric band, mounted to the carriage by a brace with upright arms, supporting the band at an angle and elevation conforming to and meeting the occipital region of the skull of a person whose head is on the carriage.

15 Claims, 4 Drawing Figures

OCCIPITAL SUPPORT FOR CERVICAL TRACTION

DESCRIPTION

1. Technical Field

The invention relates to a occipital support for use in a cervical traction apparatus.

2. Background Art

Vertebral problems in the cervical region of the spinal column usually require removal of pressure on the vertebrae. Tension is applied to elongate the cervical spine to relieve the pressure. The commonly used procedures pull the weight of the head off of the vertebrae, by suspending the head in a harness by means of a chin strap while the patient is sitting or by pulling the head by means of a strap while the patent is reclining. Such devices place a stress on the temporomandibular joint of the jaw with resultant deformity of the joint. The presence of the strap immobilizes the jaw preventing opening of the mouth for eating, drinking or talking. Since the head itself weighs about 10 pounds, weights over 10 pounds must be used to effect elongation of the cervical spine. Weights normally provided range from 10 to 25 pounds which cause considerable facial distortion, discomfort and stress on the temporomandibular joint.

Other procedures employ head straps which pull up the weight of the head by a strap around the forehead and the occipital area at the bottom back of the skull. This type of head support may be used for either the sitting or reclining patient. The presence of the tension across the forehead and in the temple area frequently causes headaches and requires more elaborate harness straps to distribute the tension.

U.S. Pat. No. 4,166,459 discloses a traction device for the reclining patient which uses a sliding carriage with a raised preshaped yoke which engages the base of the skull for applying traction forces. An elastically biased carriage holding the yoke applies force of about 10 to 13 pounds maximum. The unit must be attached to a mattress for anchoring. The fixed shape of the yoke may not adapt to a wide range of head and neck sizes, thereby not effecting a good grip during traction.

It is therefore the object of the invention to devise a occipital support for a cervical traction apparatus which relieves pressure on the cervical region by the application of force against only the occipital area of the skull without the discomfort of pressure on the face or chin. It is another object of the invention to devise a occipital support which will adjust to fit different head shapes while maintaining an equal distribution of applied force. It is another object of the invention to devise a occipital support and cervical traction device which may be used with either self-contained or auxiliary traction means.

DISCLOSURE OF THE INVENTION

The above objects have been met with a cervical traction device and occipital support apparatus which features a flexible band tilted so as to engage the base of the skull and the occipital region of the back of the skull. The construction includes a flat horizontal base supporting a movable carriage on which is mounted a brace which supports a flexible band which cradles and supports the occipital area of the skull. The weight of the head, approximately 10 pounds, maintains the tension of the resilient flexible band against the occipital bone to hold the head in place on the band. The patient reclines with the occipital area at the back of the occipital cradled in the head supporting band. The application of the force to the occipital bone rather than to the jaw or temple area while the patient is in a supine position allows the patient to recline comfortably during traction. Traction forces may be applied to the movable carriage holding the occipital support, thus pulling the head away from the cervical region and releasing pressure on the vertebrae. Such traction devices may be either incorporated in the carriage or applied from external sources permitting a wide range of traction forces to be used. Due to the flexibility of the band, all head sizes are gripped firmly during application of traction with an even distribution of force not possible with a merely deformable material.

BEST MODE FOR CARRYING OUT THE INVENTION

Figure 1:
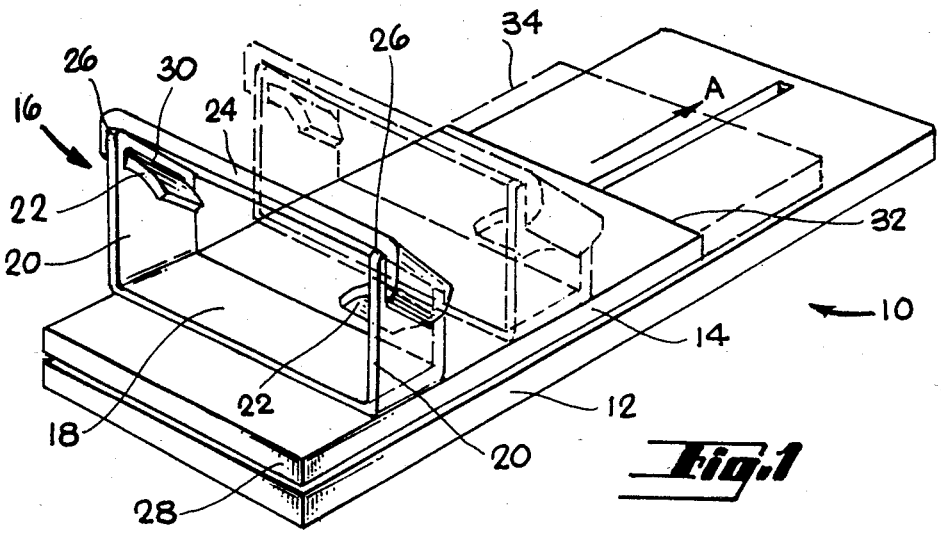
FIG. 1 is a perspective front view of the cervical traction device and occipital support of the present invention.
Figure 2:
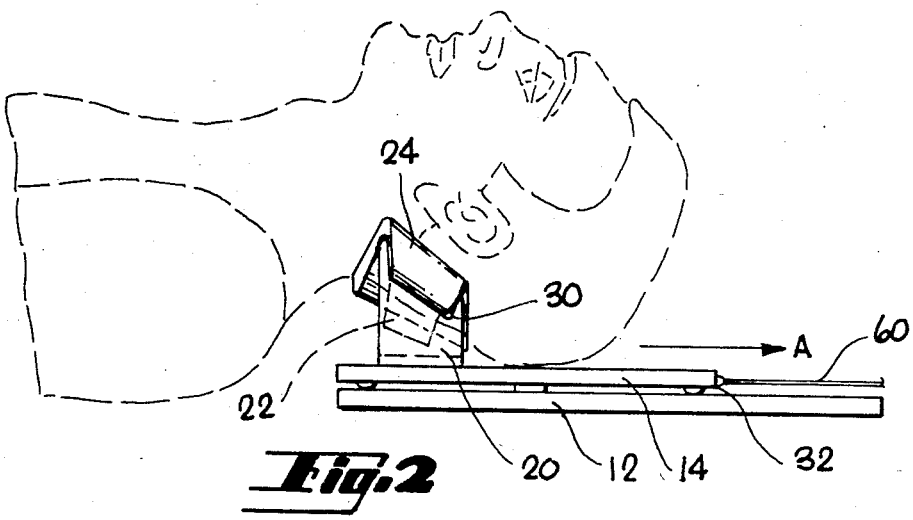
FIG. 2 is a side view of the apparatus of FIG. 1 showing the occipital support in use.

With reference to FIGS. 1 and 2, the cervical traction device and occipital support 10 has a flat elongated base 12, horizontally aligned, as shown. A flat carriage 4 is mounted so as to move horizontally over the surface of the base in the direction shown by the arrow A to the position shown by dotted line 34. In the preferred embodiment the base has the dimensions of approximately 20 inches length, seven and one-half inches width and one-half inch height. The carriage has the dimensions of 10 inches long by seven and one-half inches wide and one-half inch in height. Since the base has a similar height, the entire apparatus is quite compact.

Mounted near the front end 28 of the carriage is a occipital support assembly 16 consisting of a metal or plastic brace 18 having two upwardly extending, spaced-apart side arms 20 about three inches high and about seven and one-half inches apart from each other, which support a taut, wide flexible band 24. The side arms of the brace are of a trapezoid shape with the high point 26 of the upper extremities proximate to the front 28 of the carriage. Slots 30 are cut in the slanted upper extremities of each side arm parallel to the top edge for anchoring the band 24. Due to the angle of the slot the band lies in a tilted position at an angle between 30°–60° from the horizontal, thereby facing toward the rear 32 of the carriage. The band has a six inch midsection of about two and one-quarter inches width narrowing down to a width of about one and one-half inches at the anchoring ends. During application of traction, this wide midsection flexes under the weight of the head and cradles the head at the occipital area at the back of the skull as shown in FIG. 2. The occipital bone is a strong, flat bone at the base of the skull, joined to the atlas, the first cervical vertebra, which supports the head. Application of force to the occipital area is distributed over a wide area without facial distortion and allows the patient to rest comfortably during application of traction with freedom to move the mouth or to relax.

The occipital supporting band is made of a resilient elastomeric material such as silicone rubber and has an optimum durometer measurement of A40–A50 which flexes to fit to the shape of the occipital area of the skull when the back of the occipital is placed in the head support. Due to the angle of the band in the brace, force may then be applied by tension at the carriage rear 32 externally through line 60 or internally by spring bias on carriage 14 to the occipital area to pull the brace and head in a direction A away from the cervical area of the spine, as shown in FIG. 2. The weight of the head may rest on the carriage forward section or may be supported entirely by the band 24. As shown in FIG. 2, the anchoring ends 22 of the band pass over the upper extremities of the side arms 20 of the brace and are inserted into slots 30 from the outside, thereby providing a self-anchoring, non-slip connection when the band is weighed down by the head. The cushioning of the upper brace arm extremities also provides for added surface contact during application of force. Arrow A represents a traction means which may be a spring connected to the carriage as an onboard tension device or a weight and pulley system as an outboard tension device.

Figure 3:
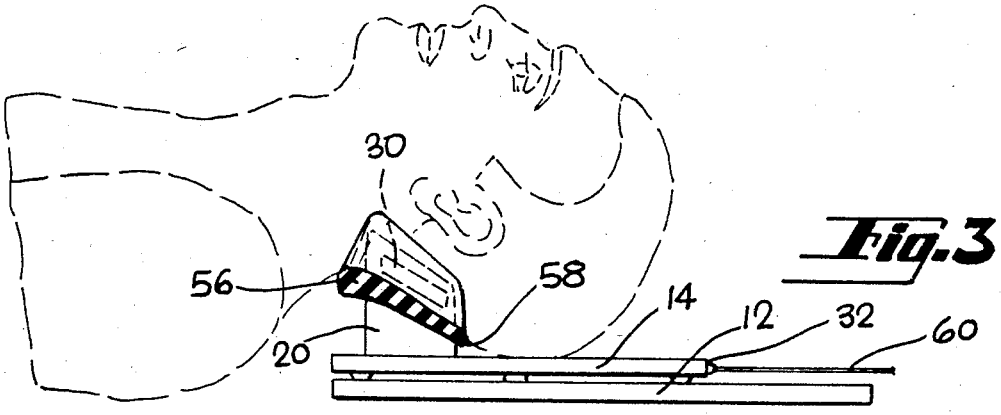
FIG. 3 is a cross section of the band of the occipital support device of FIG. 2.

As shown in FIG. 3 in the preferred embodiment, the band decreases in thickness from about three-sixteenths of an inch at the forward edge 56 to a thickness of about one-sixteenth of an inch at the backward edge 58. The thicker front edge fits against the base of the skull and the taper provides a better grip at the occipital area for various head sizes and shapes.

The user assumes a supine position, places the head across the taut band and adjusts its position in the band so as to engage the occipital area at the back of the skull. If external tension forces are employed, the carriage is at the front of the base when the head is engaged and external force is used to pull the carriage and head of the user in a direction to elongate the cervical spine and relieve pressure. The user is free to disengage from the occipital support and apparatus at any time without assistance.

Traction may be applied through the occipital support device by means of line 60 biased toward the rear 32 of the carriage, pulling the weight of the head in direction A as shown in FIG. 2. Alternately, external weights may be applied by means of pulleys attached to the carriage rear 32 through line 60 to pull the carriage holding the head in the support towards A to the position shown by dotted line 34 in FIG. 1.

Figure 4:
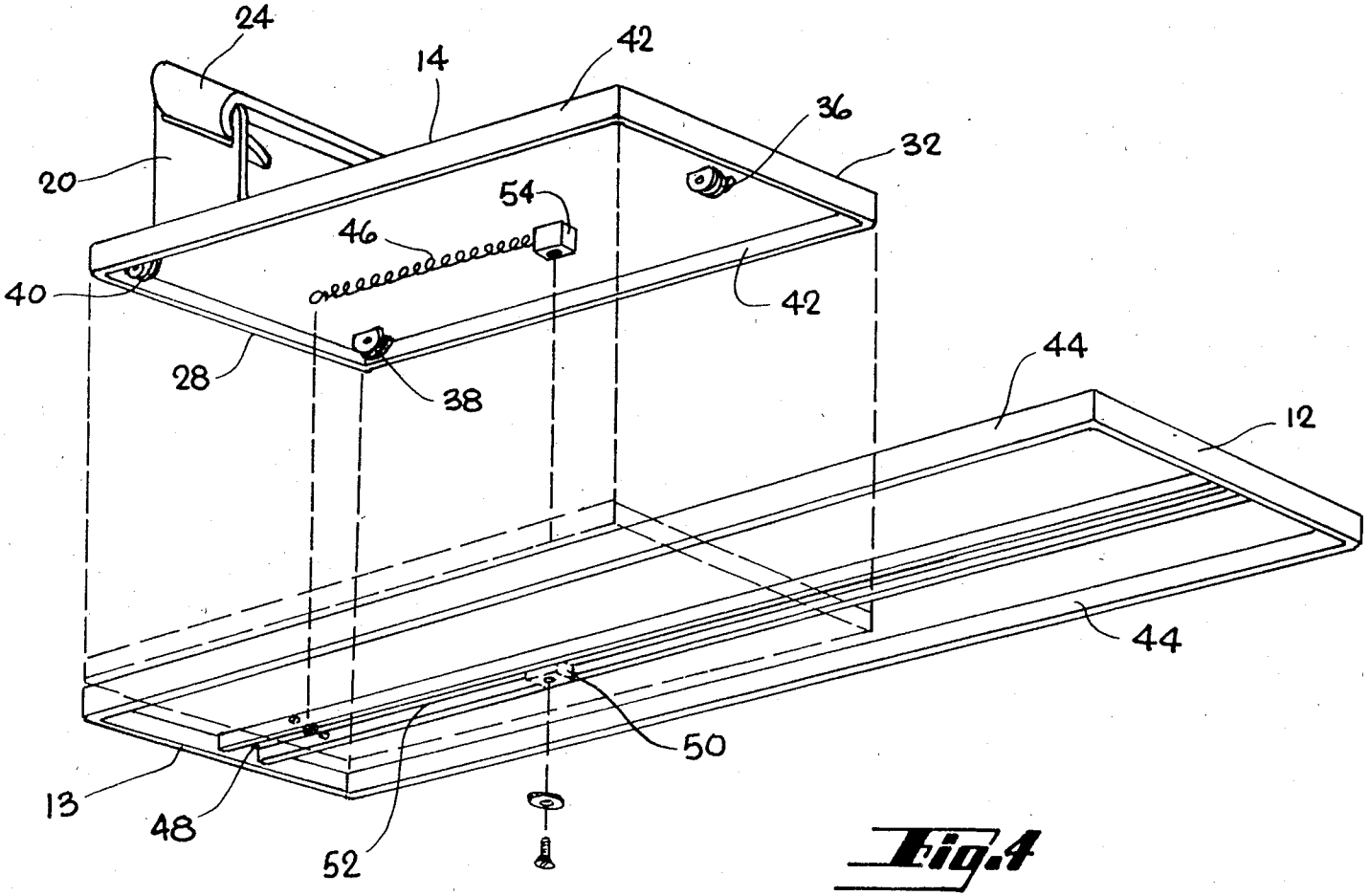
FIG. 4 is an exploded perspective view of the cervical traction device and occipital support.

As shown in FIG. 4 the carriage 14 rides on the surface of base 12 by means of three wheels 36, 38 and 40. Wheel 36 is set under the middle of the rear 32 of the carriage and wheels 38 and 40 are set under the left and right edges of the front 28 of the carriage. As shown in FIG. 4 both the base and carriage are formed with edge flanges 42 and 44 which serve to protect the wheels under the carriage and a biased spring which may be attached from the under part of the carriage to the base to bias the carriage in either a frontward or rearward direction as desired. As shown, spring 46 is attached at the front end 13 of the base, thereby biasing the carriage in a frontward direction. This returns the carriage to the front of the base after removal of external traction forces. A channel 48 extends lengthwise along the midline of the bottom surface of the base. Slider 50 runs along a slot 52 cut into the channel under the carriage area and is attached to the under surface of the carriage and the spring by means of spacer block 54. By this means the carriage is slideably mounted on the base. External traction forces may be attached to the slider to pull the carriage and support holding the reclining user's head in the direction A away from the user, thereby applying traction to the cervical region by tension at the occipital area of the head. The front biased spring 46 returns the carriage to a rest position at the front of the base when traction forces are removed. With a spring biased toward the carriage rear, it is possible to use the ten-pound weight of the supported head to maintain the carriage against the spring in an off-rest position away from A, thereby applying a ten-pound traction force to the cervical area of the spine.

The entire unit weighs approximately four pounds. The base and carriage may be molded or machined at low cost from a plastic such as acrylonitrile-butadiene-styrene resin. These ABS resins are light weight, have high impact strength, are dimensionally stable over a wide temperature range and are resistant to most solvents, oils and chemicals. The brace for the occipital support may be fabricated out of aluminum, steel or plastic.

I claim:

1. An occipital support for a cervical traction device comprising, a horizontally disposed movable carriage, having an upper surface, a rigid brace attached to the upper surface of the carriage, said brace having spaced-apart upright arms, a resilient elastomeric occipital support band having lengthwise ends, said spaced-apart upright arms of said rigid brace having a means for securing ends of said band, said band being unsupported other than at said ends and inclined at an angle by the brace so as to engage by elastomeric flexing the occipital region of the head of a user in a recumbent position relative to the carriage, with a portion of the head extending below said band, and means for moving said carriage and band in a horizontal direction so as to apply traction to the cervical spine by pulling said band against said occipital region of the head.

2. The device of claim 1 wherein said carriage is movably mounted on a flat horizontally disposed elongated support base so as to move under the influence of said traction means.

3. An occipital support for a cervical traction device comprising, a flat elongated support base adapted to be horizontally disposed and having front and rear portions, a carriage slideably mounted on the front portion of said base, a rigid brace attached to the upper surface of the carriage, said brace having spaced-apart upright arms, a resilient, elastomeric, occipital support band having lengthwise ends, said spaced-apart upright arms of said rigid brace having a means for securing ends of said band, said band being unsupported other than at said ends and inclined at an angle by the brace so as to engage by elastomeric flexing the occipital region of the head of a user in a recumbent position relative to the carriage, with a portion of the head extending below said band, whereby horizontal motion of said band relative to the head is resisted, and traction means for moving said carriage and band in a horizontal direction toward the rear of said base, thereby pulling said band against said occipital region of the head.

4. The device of claim 3 wherein said band is suspended in a tilted position transverse to the carriage direction of motion, so as to support the occipital region of the head of a user when said carriage is moved in a direction toward the rear portion of said base.

5. The device of claim 3 wherein said band has a tapered thickness with a larger dimension at the front band edge so as to engage the base of the skull, and a smaller dimension at the rear band edge so as to engage the occipital region of the skull.

6. The device of claim 3 wherein said arms have a trapezoidal shape supporting said band in a tilted position.

7. The device of claim 3 wherein said carriage is spring biased toward the front end of said support base.

8. An occipital support for a cervical traction device comprising, a flat, elongated support base adapted to be horizontally disposed and having front and rear portions, a flat carriage slideably mounted over said base, the carriage having an upper surface with front and rear portions, the carriage being smaller than the base in the base's elongated dimension, a rigid brace attached to the upper surface of the carriage, said brace having spaced-apart upright arms, a wide resilient elastomeric occipital support band mounted a small distance above the carriage surface between the arms of said brace in such a way as to define an angle of between 30° and 60° from the upper surface of said carriage, so as to engage by elastomeric flexing the occipital region of the head of a user in a recumbent position relative to the carriage, with a portion of the head extending below said band, and traction means for applying force to move said carriage from the front to the rear of said base whereby said force is applied through the band against the occipital region of the skull when a user is in a recumbent position relative to the carriage.

9. The device of claim 8 wherein said carriage is slideably mounted on said base by means of wheels vertically contacting the surface of said base.

10. The device of claim 9 further defined by a slider connected to the bottom of said carriage, said slider passing through a longitudinal slot in said base, whereby the carriage is slid back and forth on the base along the slot.

11. The device of claim 8 wherein said traction means is onboard said carriage.

12. The device of claim 8 wherein said traction means is outboard of said carriage.

13. The device of claim 8 wherein said carriage is spring biased toward the front portion of said support base.

14. The device of claim 8 wherein said support base is about twice the length of said carriage.

15. The device of claim 8 wherein said band is mounted to the front end of said carriage, thereby providing an area for the head to rest on said carriage toward the rear of said carriage.

* * * * *